United States Patent [19]

Brock

[11] Patent Number: 4,545,167

[45] Date of Patent: Oct. 8, 1985

[54] METHOD AND APPARATUS FOR MOUNTING FACING PIECES TO A BUILDING STRUCTURE

[75] Inventor: Clifford D. Brock, Louisville, Colo.

[73] Assignee: CCMC, Inc., Louisville, Colo.

[21] Appl. No.: 545,837

[22] Filed: Oct. 27, 1983

[51] Int. Cl.[4] ..... E04H 13/00

[52] U.S. Cl. ..... 52/509; 52/137; 52/379; 52/713

[58] Field of Search ..... 52/136–139, 52/128, 235, 378, 379, 509, 713, 506, 511, 512

[56] References Cited

U.S. PATENT DOCUMENTS

| | | | |
|---|---|---|---|
| 2,302,920 | 11/1942 | Sobie . | |
| 2,341,777 | 2/1944 | Hensel | 52/509 |
| 2,618,145 | 11/1952 | Sinner et al. . | |
| 2,879,660 | 3/1959 | Reintjes | 52/509 |
| 3,076,292 | 2/1963 | Arbogast . | |
| 3,342,005 | 9/1967 | Rickards et al. . | |
| 3,715,850 | 2/1973 | Chambers | 52/235 X |
| 3,778,942 | 12/1973 | Bondi . | |
| 3,888,055 | 6/1975 | Gallo . | |
| 3,905,169 | 9/1975 | Gallo . | |
| 3,990,199 | 11/1976 | Gallo . | |
| 4,021,989 | 5/1977 | Hala | 52/713 |
| 4,064,664 | 12/1977 | Gaul . | |
| 4,484,422 | 11/1984 | Roberts | 52/509 X |

FOREIGN PATENT DOCUMENTS

| | | | |
|---|---|---|---|
| 640894 | 4/1964 | Belgium | 52/379 |
| 972783 | 10/1964 | United Kingdom | 52/379 |
| 1169040 | 10/1969 | United Kingdom | 52/509 |

*Primary Examiner*—Donald G. Kelly
*Assistant Examiner*—Richard E. Chilcot, Jr.
*Attorney, Agent, or Firm*—Burton & Dorr

[57] ABSTRACT

A method and apparatus is provided for attaching facing pieces to building structures in predetermined horizontal row and vertical tier arrangements. This method and apparatus is particularly well-suited for mounting removable marble face stones to crypt vaults in mausoleums. Anchor blocks are set in the structure in predetermined vertical and horizontal alignment positions and mounting bolts upon which the facing pieces hang are inserted into the anchor blocks. The mounting bolts are characterized by their ability to produce an eccentric motion which is used to cam the facing piece horizontally or vertically and thereby providing means for making small adjustments necessitated by the fact that the building structure and/or the face pieces have slightly irregular dimensions. Shims are used to make adjustments in the third dimension.

32 Claims, 14 Drawing Figures

Fig. 2
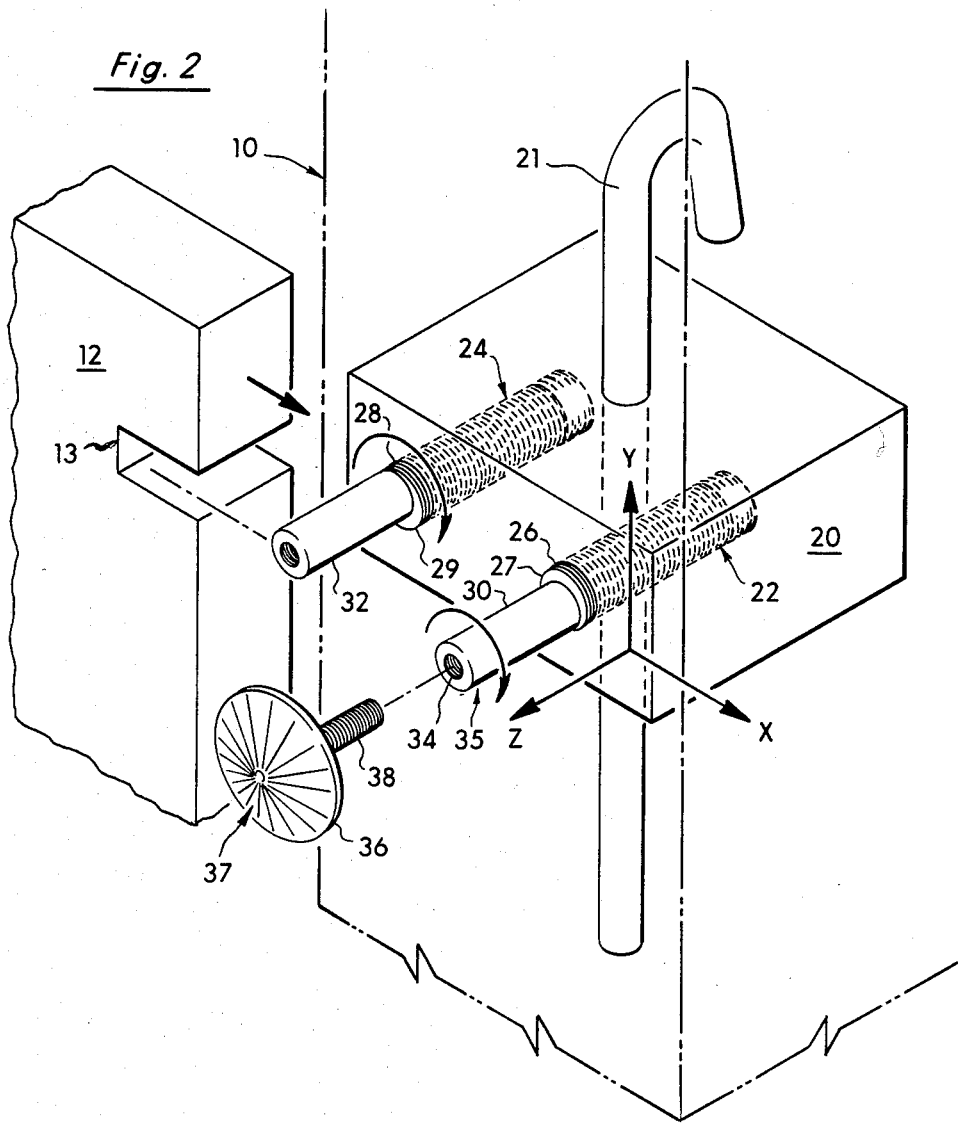
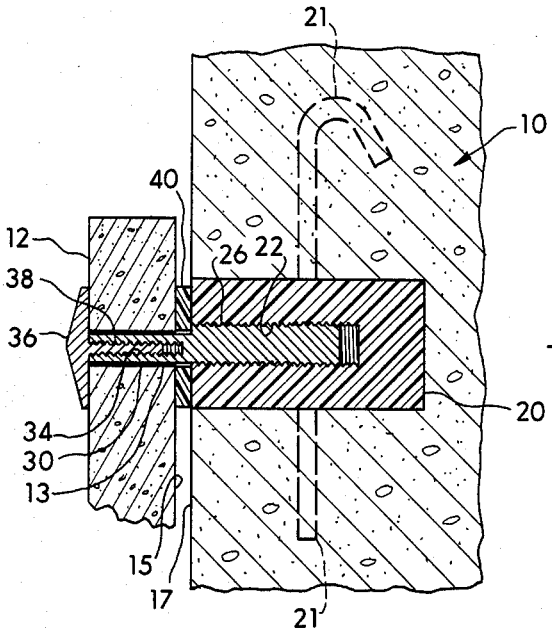
Fig. 3

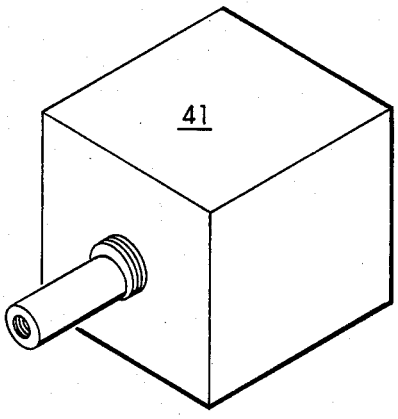
Fig. 4
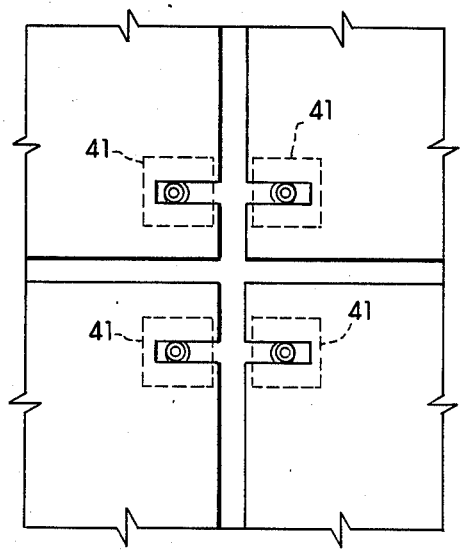
Fig. 5
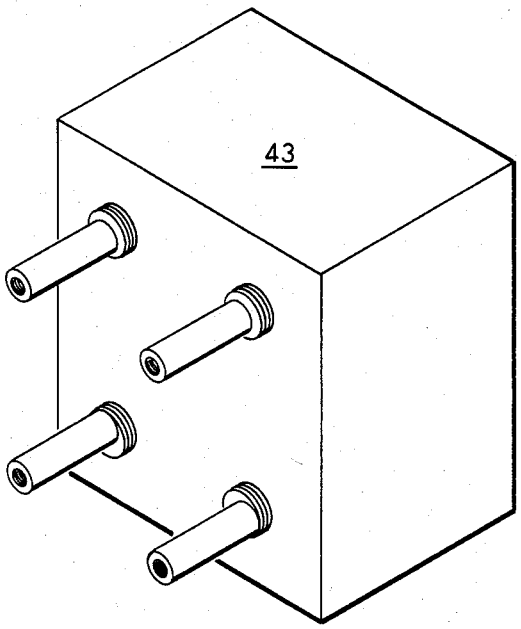
Fig. 6
Fig. 7
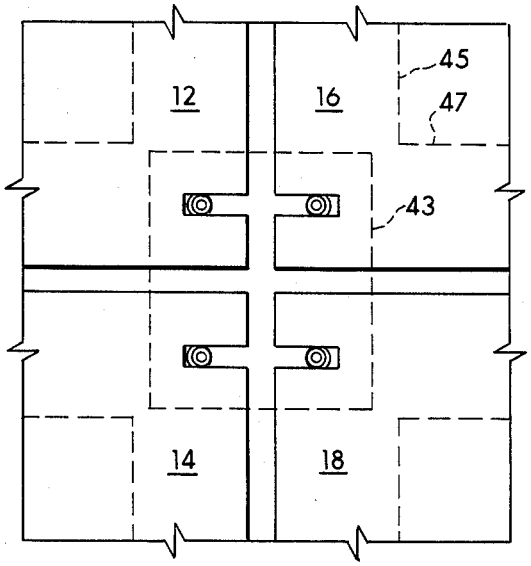

Fig. 8
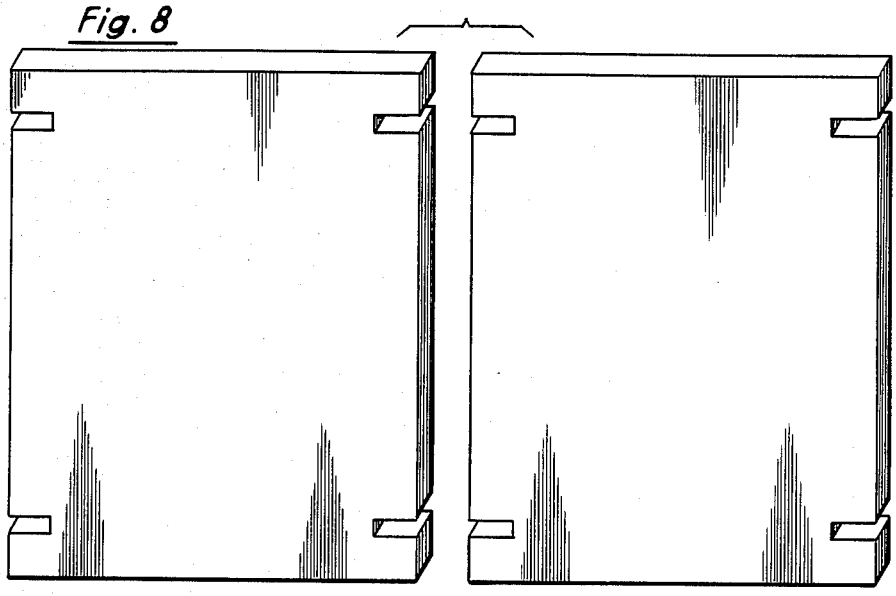
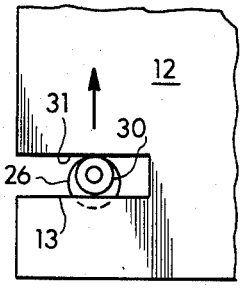
Fig. 9
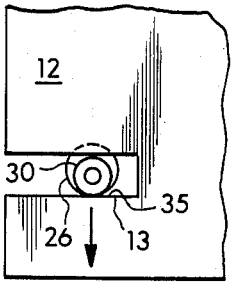
Fig. 10
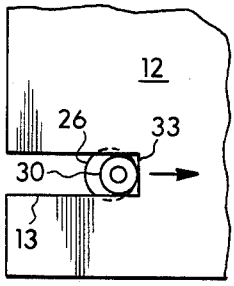
Fig. 11
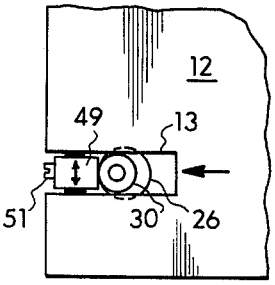
Fig. 12
Fig. 13
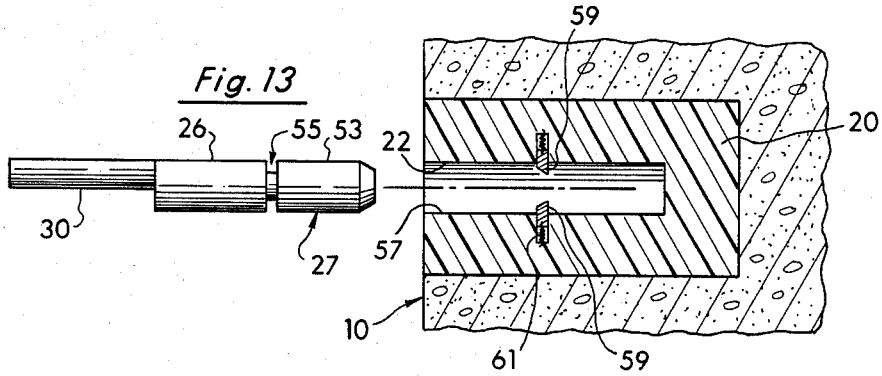
Fig. 14
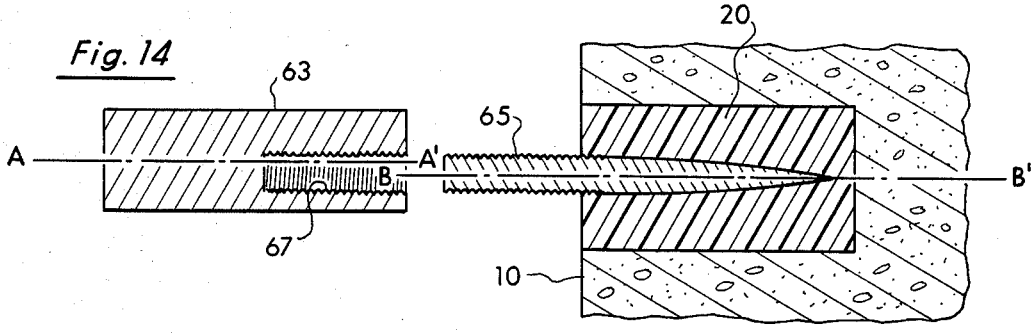

METHOD AND APPARATUS FOR MOUNTING FACING PIECES TO A BUILDING STRUCTURE

BACKGROUND OF THE INVENTION

1. Field of the Invention

This invention relates generally to mounting face pieces to buildings. It is particularly concerned with mounting marble and artificial marble face pieces to public buildings, commercial buildings, towers and most particularly to the fronts of crypts arranged in horizontal rows and vertical tiers in mausoleum walls. This invention is particularly well suited for mausoleum construction because it provides a method and apparatus for removably fastening slabs of marble, artificial marble and like materials used to conceal individual crypts in mausoleum walls while simultaneously providing a means for bringing these slabs into esthetically pleasing horizontal row and vertical tier alignments.

2. Prior Art

The methods and apparatus disclosed by the prior art for mounting face pieces onto a structure generally involve embedding anchor blocks into the structural material (e.g. concrete, steel and marble). The anchor blocks are generally provided with one or more anchor bolts which are in turn attached to backing plates having slots for receiving the anchor bolts. These slots provide for slight vertical and/or horizontal adjustments of the backing plates which in turn provides for adjustments of the face pieces. These adjustments are usually necessary because the dimensional tolerances for marble slabs and the concrete walls to which they are attached are each about one-eighth of an inch. Hence adjustments of up to about one-quarter inch are often necessary to compensate for these discrepancies. The ability to make these small adjustments is particularly helpful in those situations where some of the face pieces must be removed and replaced as in the case of burial crypts located in mausoleum walls. Representative methods for making small adjustments of this type are taught in U.S. Pat. Nos. 2,618,145; 3,905,169 and 3,990,199. Generally the corners of four face pieces are held in a quadrant arrangement by slidable brackets having a quadrant shoulder section and a slot to receive a bolt which extends horizontally from a wall of the structure through a hole formed by removing the corner of each of the four face pieces. The bolt is extended through the resultant hole and ends in a bolt head which holds the face pieces in their quadrant relationship between the bolt head and the bracket. The bolt head normally has a rosette or other decorative plate to hide the hole formed by the removal of the corners of the four pieces. However, the use of slotted mounting brackets constructed to receive four adjoining face pieces in a quadrant arrangement presents certain drawbacks. For example, the use of slotted mounting brackets has not totally solved the vertical and horizontal alignment problems because the great weight of the marble facing pieces often causes the bracket to slip with respect to the mounting belt. Furthermore, many of the prior art bracket slots are only adjustable in a vertical direction or in a diagonal direction in the manner taught in U.S. Pat. No. 3,778,942. Therefore these arrangements give limited horizontal plane adjustment capabilities. Furthermore, the prior art mounting bracket arrangements with their quadrant shoulder sections do not readily permit third dimension i.e., depth adjustments between the face pieces and the walls to which they are attached. That is, they do not permit variations in the spacing relationship between the back of the face piece and the front of the wall or the front of the mounting brackets. Alignment limitations in any of the three dimensions are particularly vexatious when the front pieces of a structure must be periodically removed and replaced as in the case of a burial mausoleum having a different face piece for each individual crypt. Furthermore, the use of one mounting bolt to hold a slidable bracket which in turn holds four adjacent face pieces also poses safety problems. When four of these mounting bolts are removed so that one face piece can be removed to allow for insertion of a casket in a crypt, the adjoining face pieces sometimes slip or even fall from the mausoleum wall from lack of support at the corner where the bolt was removed. Hence the ability to make minor vertical and horizontal adjustments without the use of mounting brackets which can slip with respect to their mounting bolts would be of great advantage. Furthermore, the ability to make depth adjustments in conjunction with these horizontal and vertical adjustments would also of great practical value. From the safety point of view, it would be particularly beneficial if the loosening of one face piece did not concomitantly loosen the adjoining ones.

SUMMARY OF THE INVENTION

One of the principal objects of the present invention is to provide an improved method and apparatus for installing decorative walls requiring horizontal, vertical and, if needed, depth alignment of face pieces on those walls. The method and apparatus of this invention provides a means for aligning said pieces by making small horizontal and/or vertical adjustments by use of mounting bolts having eccentric support sections. Depth adjustments can be made, when needed, by shimming means, e.g. shims, washers, lock washers, etc., placed on the mounting bolts between the face piece and the structure's wall. The method and apparatus of this invention also provides a means for adjusting each piece without having to loosen any adjoining face pieces. Individual face pieces can also be completely removed and replaced without loosening the adjoining face pieces. This is particularly convenient in the mausoleum context since individual face pieces for each crypt must be periodically removed and replaced as coffins are interred.

The first step of a preferred embodiment of the method of this invention is to place anchor blocks in predetermined vertical and horizontal alignment positions on the face of the structure. Preferably the anchor blocks are embedded in the concrete which forms the support members of the structure. The anchor blocks are provided with means for attaching the eccentric mounting bolts to said anchor blocks. The anchor blocks and, more importantly, the means for attaching the eccentric mounting bolts to them will also be aligned in horizontal and vertical arrays. In another embodiment of this invention, a mounting bolt means can be embedded directly into the material of the vertical wall itself without the use of the anchor blocks. However, the mounting means still will be in a predetermined array. In all cases, the object of these anchor block and/or mounting bolt arrays is to place the means for attaching the eccentric mounting bolts to the anchor blocks or to the walls themselves in predetermined, horizontally and/or vertically aligned arrays. The resulting array of mounting bolts will then be in position to mount an array of precut face pieces having precut slots for receiving the eccentric mounting bolts. Generally the length, width and thickness of the face pieces, as well as the slots cut in them, will be precut to tolerances varying from about one-eighth to one-quarter of an inch. Hence the sought after eccentric motion should be capable of at least compensating for the cumulative effect of these expected one-eighth to one-quarter inch discrepancies.

Most preferably, the mounting bolts used in this invention will be comprised of a round threaded base section adapted for threaded insertion into formed threaded holes in the anchor blocks and a support section which extends from the base section of the mounting bolt with said support section being mounted to the base section in an eccentric manner such that when the base section is turned in the anchor block the support section rotates in the manner of a cam and thereby urges an associated face piece vertically and/or horizontally with respect to the structure. Slots are provided in the face pieces for receiving the support section of the mounting bolt. The slots will have a width which is only slightly larger than the diameter of the support section of the mounting bolt such that when the anchor bolt is turned in the anchor block the support section acts as a cam upon an inside surface of the slot.

Although the preferred means for attaching the eccentric mounting bolts to the mounting blocks is to have formed threaded holes in the anchor blocks for receiving threaded base sections of the mounting bolts, as described above, there are other methods and means by which the mounting bolts can be attached to the mounting blocks. For example, the mounting block could have a smooth hole with an inwardly biased lock ring associated with the hole such that when a mounting bolt having a smooth base section and a lock ring reception means is inserted into the hole, the inwardly biased lock ring of the hole engages with the lock ring reception means of the mounting bolt. Obviously, the same effect could be achieved if the lock ring reception means were in the hole and the lock ring were biased outwardly and made a part of the base section of the mounting bolt. Still another alternative would be to fixedly embed mounting bolts directly into the wall or into the anchor blocks. An outwardly protruding portion of the bolts could be provided with reception means such as threads for receiving detachable, eccentric shaped support sections having reception means such as threaded holes for engaging the protruding threaded mounting bolts. In all cases however, the object of the means for attaching the mounting bolts to the anchor blocks or to the wall itself is to produce an eccentric, camming motion of the support section as it rotates. Preferably, the rotation of a unitary mounting bolt and support section, or the rotation of an independently rotatable support section is only obtained by strong torque forces supplied by tools. That is to say, the heavy weight of the face piece is best supported by a support section which does not turn under the weight of the face piece alone, but rather must be torqued into the desired camming position. To this end the mounting bolt could be provided with a section having a square, hexagonal, etc. cross section for receiving a torque producing tool such as a wrench.

The methods and apparatus of this invention will be better understood and additional objects and advantages will become apparent from the following drawings and descriptions of the preferred embodiments.

BRIEF DESCRIPTION OF THE DRAWING

FIG. 2 is a fragmentary perspective view of a anchor block embedded within a vertical support member of a building structure and two eccentric anchor bolts inserted into said anchor block; a facing piece such as a marble slab having a slot for receiving the eccentric bolt is shown near the bolt.

FIG. 3 is a side view of the anchor block and its associated anchor bolt holding a face piece in position.

FIG. 4 is a perspective view of an anchor block having one anchor bolt.

FIG. 5 shows a front view wherein four separate anchor pieces such as the one shown in FIG. 4 are used to mount the corners of four face pieces.

FIG. 6 shows an anchor block having four mounting bolts.

FIG. 7 shows the anchor piece of FIG. 6 being used to mount the corners of four face pieces.

FIG. 8 shows two typical adjacent face pieces each having four slots for receiving their respective mounting bolts.

FIG. 9 is a front view of a mounting bolt showing its eccentric support section cammed upward on a slot in a face piece.

FIG. 10 is a front view showing the face piece cammed downward.

FIG. 11 is a front view of the mounting bolt cammed to the right on the vertical side of a slot in the face piece.

FIG. 12 shows the face piece cammed to the left with the aid of a device adapted for insertion within the slot.

FIG. 13 is a cross sectional view of an alternative device for attaching the eccentric mounting bolt to the mounting block.

FIG. 14 is a cross sectional view of another alternative apparatus for attaching an eccentric bolt to a wall wherein an eccentric support section is threaded into an anchor bolt fixedly embedded with the wall itself or within an anchor block which is, in turn, embedded into the wall.

DESCRIPTION OF THE PREFERRED EMBODIMENTS

Figure 1:
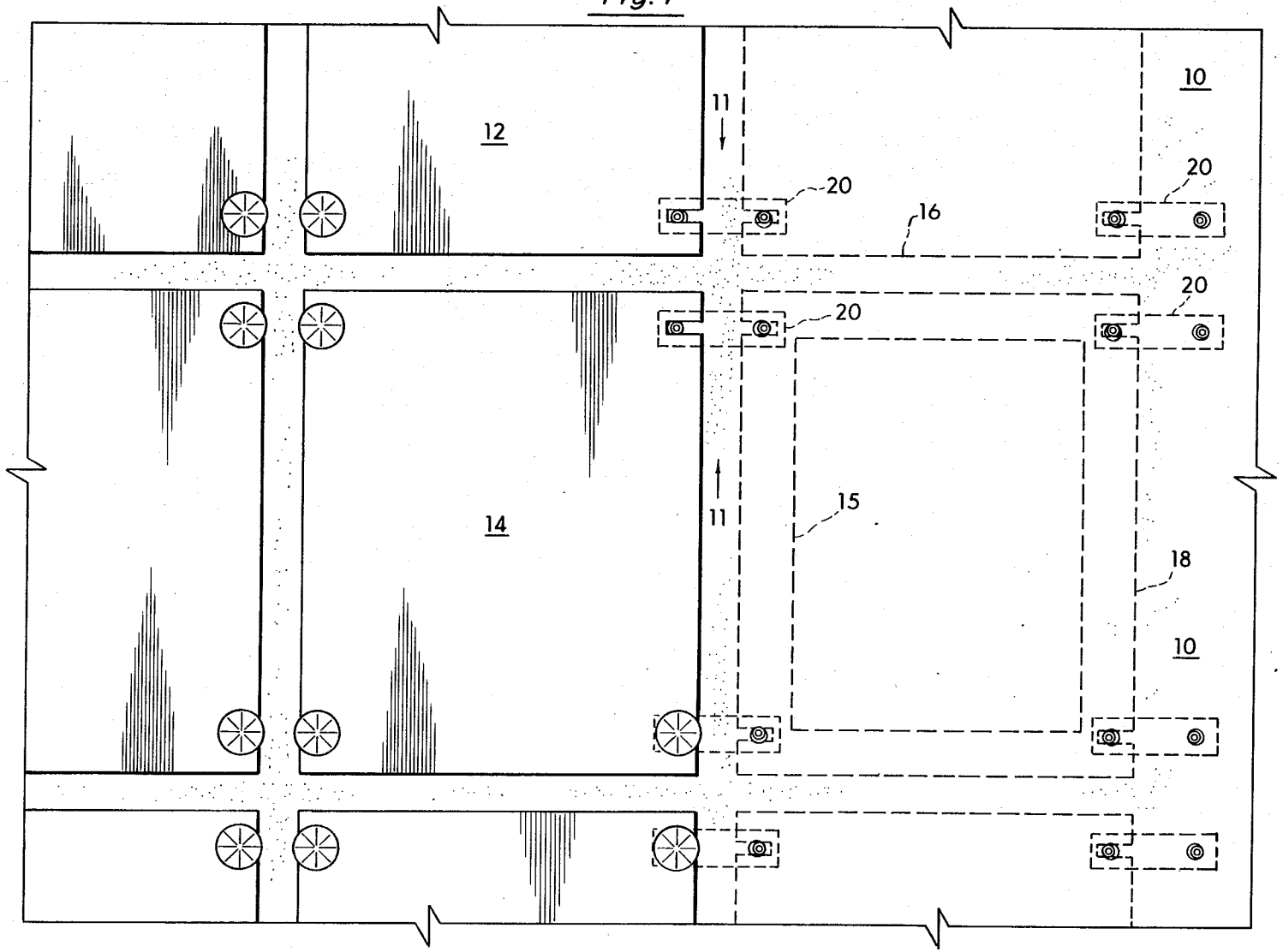
FIG. 1 is a front view of a vertical wall of a structure having horizontal rows and vertical tiers of face pieces which are individually attached to the wall in a rectangular array.

FIG. 1 is a front view of a wall 10 to which face pieces 12, 14, 16, and 18 are attached in a rectangular array. The face pieces typically will be made of marble, synthetic marble or other decorative facing material. Synthetic marble is the preferred material since the slots needed to practice this invention can be cut into synthetic marble with less risk of cracking than with natural marble. This invention is particularly concerned with mausoleum walls having burial crypts arranged in horizontal rows and vertical tiers. In this burial crypt context, the fronts of the crypts would be closed by face pieces which are also designated as 12, 14, 16, and 18. In a preferred embodiment of this invention, anchor blocks 20 are embedded within the concrete or other material forming the vertical structural members 11 of the structure. The anchor blocks 20 will most preferably be made of a plastic material and have threaded holes for receiving one or more mounting bolts as part of a predetermined mounting bolt array. A preferred arrangement shown in FIG. 1 features anchor blocks 20 having two holes in substantially horizontal alignment for receiving two horizontally aligned mounting bolts.

FIG. 2 shows a perspective view of an anchor block, mounting bolt, and the face piece to be held and adjusted by the methods and apparatus of this invention. The anchor block 20 is shown embedded within the material comprising the wall 10 of the structure. The anchor block 20 can be embedded in the wall face before or after construction of the structure. However, a highly preferred technique is to place the anchor block in the wet concrete building material such that when the material dries the anchor block is embedded therein. To this end, a representative anchor bar 21 is shown attached to the anchor block 20. Preferably, the anchor blocks are further provided with one or more formed threaded holes 22 and 24 for receiving mounting bolts 26 and 28. FIG. 2 shows an anchor block 20 with two such mounting bolts; however the anchor block an have any number of holes, e.g., one or four as shown in FIGS. 4 and 6 respectively. As previously noted, means other than formed threaded holes can be provided for rotatably attaching the mounting bolts to the anchor block or to the wall. In any event, the mounting bolts 26 and 28 as shown in FIG. 2 each comprise two distinct sections, the base sections 27 and 29 which are threaded into the holes 22 and 24 of the anchor block 20 and the support sections 30 and 32 which extend beyond the base sections 27 and 29 of their respective mounting bolts 26 and 28. Preferably the support sections are round or elliptical, externally smooth and extend from the base sections 27 and 29 as unitary extensions of the base sections i.e., they are cast as a single unit. However, the round support sections 30 and 32 do not have the same end view center lines as their respective base sections 27 and 29, but rather are mounted off-center from the base sections. This offsetting of the support section from the base section creates a cam-like arrangement such that when the base section is threaded into or out of the anchor block the support section rotates as a cam. If, however, the support sections were of an elliptical shape rather than the round ones shown in FIG. 2, the camming action could be produced even if the support section and base section had the same center line. In either case, however, this camming action provides the capability for moving a face piece 12 along the X and Y axes indicated. By way of example, FIG. 2 shows support section 30 in a downward cammed position and support section 32 in an upward cammed position. The support sections will have a diameter slightly smaller than the width of a slot 13 of the face piece 12 which is shown about to be inserted around the support section 32. The face piece 12 is most conveniently held in an abutting relationship to the vertical wall 10 by means of a face plate 36. This relationship can be adjusted by shimming means hereinafter discussed in conjunction with FIG. 3. Preferably face plate 36 can be easily attached and detached with respect to some element rigidly associated with the structure. For example, the face plate 36 can be attached to the end of the mounting bolt 26 by a stem means 38 shown in FIG. 2, or it can be attached directly to the anchor block 20 or to the structure 10 itself. In any case, the face plate 36 preferably will have a decorative head 37 large enough to hide the unesthetic appearance of the slot 13 through which it is attached to the structure. A preferred technique for attaching the face plate 36 to the mounting bolt 26 is to provide the face plate 36 with a threaded stem 38 which is threaded into a threaded hole 34 in the end of the support section 30 of the mounting bolt 26. As previously noted the threaded stem 30 could avoid the mounting bolt 26 and extend all the way to the mounting block 20 itself. This arrangement is however less preferred. Other methods for the attachment of the face plate 36 to the bolt might include for example a compression fit of a hollow stem around a support section 30 which is only slightly smaller in diameter. However, as in the case of the attachment of the mounting bolt 26 to the anchor block 20, the attachment of the face plate 36 to the mounting bolt 26, or to the anchor block 20 or to the structure 10 itself preferably would be accomplished by means of a threaded relationship.

FIG. 3 is an end view of the arrangement shown in FIG. 2. In addition, it shows a shimming means 40 around the support section 30 being used to close a space between the back side 15 of the slab 12 and the front side 17 of the structure 10 and thereby providing an abutting relationship between the wall 10, the face plate 36 and the face piece 12. Washers, lock washers and/or shims having holes into which the mounting bolt 26 can be inserted can thus be used to compensate for the fact that the walls of the structures may be slightly irregular from true vertical and/or compensate for the fact that the face pieces may have slightly irregular thicknesses. In effect these shimming means 40 provide a capability for making adjustments of the face piece in the depth plan of the Z axis indicated in FIG. 2. Such shimming means may be placed around the base section 26 and/or around the shoulder section 30.

FIG. 4 illustrates another embodiment of an anchor block 41 of the present invention having only one formed threaded hole containing a mounting bolt. FIG. 5 shows the use of four single anchor blocks such as the one shown in FIG. 4 with each block used in the mounting of one corner of four adjoining face pieces. FIG. 6 sets forth yet another embodiment of an anchor block 43 having four formed threaded holes containing four mounting bolts in a substantially rectangular array. FIG. 7 shows how the anchor block 43 having four mounting bolts might be embedded at the intersection of a vertical wall 45 and a horizontal floor 47. Each of the four bolts could then receive respective corners of four adjoining face pieces 12, 14, 16, and 18.

FIG. 8 shows two typical face pieces each having four slots for receiving the support sections of four mounting bolts. These face pieces can be adapted for placement in vertically aligned, repeating arrays of horizontal rows and vertical tiers or in alternating mosaic patterns known to the brick laying and tile setting arts. Since each piece is held by its own mounting bolts, each piece will stay in place even if the neighboring horizontal or vertical pieces are removed. This individual mounting provides for greater safety when front pieces are temporarily removed. The position of the slots emphasizes that in this embodiment, which is preferred, each face piece is held by four mounting bolts. The two parallel formed threaded hole arrangement of FIG. 2 is the preferred mounting block configuration for mounting the face pieces shown in FIG. 8.

FIGS. 9 through 12 illustrate the method of the present invention for adjusting a face piece so that the edges of all face pieces can be horizontally and/or vertically aligned. FIGS. 9 and 10 illustrate vertical adjustment by showing a slab 12 having a slot 13 with the support section 30 of the mounting bolt inserted therein. In FIG. 9, the bolt 26 is turned such that the support section 30 is in its highest possible position and urges the underside of the slab slot 31 upward as indicated. FIG. 10 shows the support section 30 cammed in its most downward position thereby urging the bottom side of the slab slot 35 downward as indicated.

FIG. 11 shows the support section 30 in its rightmost position camming the right side of the slot 33 to the right as indicated. FIG. 12 shows the use of an auxiliary piece 49 which is inserted into the slot 13. By expansion bolt means 51, or otherwise, the auxiliary piece 49 is urged upward and downward as shown by the direction of the arrows to fix the auxiliary piece 49 within the slot 13. After said auxiliary piece 49 is fixed within the slot 13, the support section 30 can be cammed to the left as shown to create a leftward directed force on the face piece 12 as shown.

FIGS. 13 and 14 illustrate alternative embodiments of some of the elements of this invention. FIG. 13, for example, illustrates how the mounting bolt's base section 27 can have a smooth surface 53 rather than the threaded base section shown in FIG. 2. Such a base section 27 can be further provided with an engaging slot 55 to receive a locking means 59 located within the hole 22 of the anchor block 20. The locking means 59 can be a compression ring, lock ring or cotter key having a biasing means 61 for engaging the locking means 59 to the engaging slot 55 of the mounting bolt 26. In another alternative, the mounting bolt and anchor block relationship could also be based upon a compression fit between these two elements.

FIG. 14 illustrates how eccentric motion of a support section 63 which is independent of its mounting bolt 65 can be employed to produce the caming action employed in this invention. Again, the camming action of a round shoulder section is produced by the fact that the center line A–A′ of the support section 63 does not coincide with the center line B–B′ of the mounting bolt 65 when the mounting bolt 65 is inserted into the support section's formed threaded hole 67. In the case of an elliptical support section, eccentric motion can be produced when the center lines coincide or when they are offset as shown in the case of the round support section 63 of FIG. 14. Again the function of the support section is to produce eccentric motion as it turns in order to cam the face piece. FIG. 14 is also intended to convey the idea that the mounting bolt could be fixedly embedded directly into the material of the wall 10 itself as well as into an anchor block 20 which is in turn embedded into the wall 10.

Since other embodiments obvious to those skilled in the art might be made in the above disclosed method and apparatus, it is to be understood that all matters herein set forth and shown in the accompanying drawings are to be interpreted as illustrative and not in a limiting sense.

Thus having disclosed my invention, I claim:

1. An apparatus for attaching face pieces to a structure said apparatus comprising:

an array of mounting bolts fixedly attached to the structure in predetermined horizontal row (x-axis) and vertical tier (y-axis) alignment positions, said mounting bolts being capable of receiving face plates and having eccentric support sections which, upon being turned, urge inside surfaces of slots in the face pieces so that said face pieces are fixed in alignment positions whose depth (z-axis) is fixed by compressing the face pieces between their respective face plates and the structure.

2. A method for attaching face pieces to a structure, said method comprising: setting an array of mounting bolts in the structure in predetermined horizontal row (x-axis) and vertical tiers (y-axis) alignment positions, said mounting bolts being capable of receiving face plates and of producing eccentric motion of support sections of the mounting bolts as the support sections are rotated and thereby urging inside surfaces of slots in the face pieces so that said face pieces are fixed in alignment positions whose depth (z-axis) is fixed by compressing the face pieces between their respective face plates and the structure.

3. The method of claim 2 wherein the setting of the face pieces between the face plates and the structure is accomplished by threaded cooperation between face plate stems and the mounting bolts.

4. A method for attaching face pieces to a structure in predetermined horizontal row and vertical tier arrangements, said method comprising:

setting an array of anchor blocks in the structure in predetermined horizontal row (x-axis) and vertical tier (y-axis) alignment positions, said anchor blocks being capable of rotatably receiving mounting bolts which are also set in predetermined horizontal row and vertical tier alignment positions with respect to other mounting bolts of a mounting bolt array;

locating mounting bolts in the anchor blocks, said mounting bolts being capable of receiving face plates, rotatable cooperation with the anchor blocks and providing eccentric motion of support sections of the mounting bolts such that when the mounting bolts are rotated in their respective anchor blocks, the support sections rotate as cams and thereby urge face pieces having slots into which the support sections are inserted;

locating slots in the face pieces so that the slots receive their respective mounting bolt support sections, said slots having width which are only slightly larger than the diameter of the support sections such that when the mounting bolts are rotated, the support sections act as cams upon the inside surfaces of the slots, thereby providing vertical and horizontal adjustments of the face pieces; and setting the face pieces in alignment positions whose depth (z-axis) is fixed by compressing the face pieces between their respective face plates and the structure.

5. The method of claim 4 which further comprises shimming the face pieces to an aligned depth relationship with respect to other face pieces in the horizontal row and vertical tier arrangements.

6. The method of claim 4 wherein the rotatable cooperation between the mounting bolts and anchor blocks is achieved by threaded cooperation between formed threaded holes in the anchor block and threaded ends of the mounting bolts.

7. A method for attaching individually removable face pieces to burial crypt structures having horizontal row and vertical tier partitions defining individual crypts, said method comprising:

setting an array of anchor blocks in the partitions in predetermined horizontal row (x-axis) and vertical tier (y-axis) alignment positions, said anchor blocks being capable of rotatably receiving mounting bolts which are also set in predetermined horizontal row and vertical tier alignment with other mounting bolts of a mounting bolt array;

locating mounting bolts in the anchor blocks, said mounting bolts being capable of receiving face plates, rotatable cooperation with the anchor blocks and providing eccentric motion of support sections of the mounting bolts such that when the mounting bolts are rotated in their respective anchor blocks, the support sections rotate as cams and thereby urge face pieces having slots into which the support sections are inserted;

locating slots in the face pieces so that the slots receive their respective mounting bolt support sections, said slots having widths which are only slightly larger than the diameter of the support sections, such that when the anchor bolts are rotated in the anchor blocks the support sections act as cams upon inside surface of the slots, and thereby providing vertical and/or horizontal adjustments of the face pieces; and setting the individually removable face pieces in alignment positions whose depth (z-axis) is fixed by compressing the face pieces between their respective face plates and the structure.

8. The method of claim 7 which further comprises shimming the individually removable face pieces to an aligned depth relationship with respect to other face pieces in a mausoleum wall.

9. The method of claim 7 wherein the rotatable cooperation between the mounting bolts and the anchor blocks is accomplished by threaded cooperation between threaded holes in the anchor blocks and threaded ends of the mounting bolts.

10. The method of claim 7 wherein the setting of the individually removable face pieces between face plates and the crypt is accomplished by threaded cooperation between face plate stems and the mounting bolts.

11. The method of claim 7 wherein the setting of the anchor blocks is accomplished by locating the anchor blocks in a horizontal plane in a vertical tier partition of a crypt structure.

12. The method of claim 7 wherein the setting of the anchor blocks is accomplished by setting the anchor blocks in wet concrete of the crypt partitions so that their mounting bolts will be located in predetermined vertical and horizontal alignment positions.

13. The method of claim 7 which further comprises horizontally and vertically aligning anchor blocks having two horizontally aligned mounting bolts.

14. The method of claim 7 wherein the camming action is produced by rotating mounting bolts having round, eccentrically mounted shoulder sections.

15. The method of claim 7 wherein the camming action is produced by rotating mounting bolts having elliptical support sections.

16. The method of claim 7 wherein the setting of the array of anchor blocks is accomplished by locating the anchor blocks in a horizontal plane located by intersections of the horizontal row and vertical partitions of the crypts.

17. The method of claim 7 wherein the face plates are set so as to hide the slots in the face pieces.

18. A method for attaching face pieces to a structure, said method comprising: setting an array of mounting bolts, capable of individually receiving face plates, in the structure in predetermined horizontal row (x-axis) and vertical tier (y-axis) alignment positions, rotatably attaching separate eccentric motion producing support sections to the mounting bolts so that as said support sections rotate with respect to their respective mounting bolts and thereby urging inside surfaces of slots in the face pieces so said face pieces are fixed in alignment positions whose depth (z-axis) is fixed by compressing the face pieces between their respective face plates and the structure.

19. The method of claim 18 which further comprises shimming the face piece to an aligned depth relationship with respect to other face pieces in a face piece arrangement.

20. The method of claim 18 wherein the attaching of the support sections to the mounting bolts is by threaded cooperation.

21. An apparatus for attaching face pieces to a structure in predetermined horizontal row and vertical tier arrangements, said apparatus comprising:

an array of anchor blocks embedded in the building structure in predetermined horizontal row (x-axis) and vertical tier (y-axis) alignment positions, said anchor blocks having means for rotatably receiving mounting bolts which are also set in a predetermined horizontal row and vertical tier alignment with other mounting bolts of a mounting bolt array;

mounting bolts adapted for rotatable cooperation with the anchor blocks, said mounting bolts comprising a base section adapted for rotatable cooperation with an anchor block and a support section which extends from the base section, with said support section being mounted to the base section in an eccentric manner such that when the base section is rotated in the anchor block, the support section rotates as a cam and thereby urges a face piece, having a slot into which the mounting bolt is inserted;

face pieces having slots for receiving the support sections of the mounting bolts, said slots having widths which are only slightly larger than the diameter of the support sections such that when the mounting bolts are rotated in the anchor blocks, the support sections act as cams upon the insides of the slot surfaces and thereby vertically and/or horizontally adjusting the face pieces; and face plates for fixing the face pieces in alignment positions whose depth (z-axis) is fixed by compressing the face pieces between their respective face plates and the structure.

22. The apparatus of claim 21 which further comprises means for shimming the face piece to an aligned depth relationship with respect to other face pieces in the horizontal row and vertical tier arrangements.

23. The apparatus of claim 21 wherein the means for rotatably receiving the mounting bolts are formed threaded holes in the anchor blocks.

24. The apparatus of claim 21 wherein the face plates have decorative heads and threaded stems which are threaded into formed threaded holes in the support sections of the mounting bolts.

25. The apparatus of claim 21 wherein the mounting bolts further comprise smooth, round, eccentrically mounted support sections.

26. The apparatus of claim 21 wherein the mounting bolts further comprise smooth, elliptical, support sections.

27. The apparatus of claim 21 wherein the anchor blocks further comprise two formed threaded holes in horizontal alignment.

28. The apparatus of claim 21 wherein the anchor blocks further comprise two formed threaded holes in horizontal alignment in a plastic material and further comprise an anchor bar embedded in a concrete face of the structure while said concrete is still unsolidified.

29. The apparatus of claim 21 wherein the face pieces each comprise a rectangular slab of artificial marble having a horizontal slot near each corner of said rectangular slab.

30. An apparatus for attaching face pieces to a structure, said apparatus comprising: an array of mounting bolts set in the structure in predetermined horizontal row (x-axis) and vertical tier (y-axis) alignment positions, means for rotatably attaching separate, eccentric motion producing support sections to the mounting bolts so that rotation of said support sections with respect to the mounting bolts produces horizontal and/or vertical urging of inside surfaces of slots cut in the face pieces and face plate means for fixing the face pieces in alignment positions whose depth (z-axis) is fixed by compressing the face pieces between their respective face plate means and the structure.

31. The apparatus of claim 30 which further comprises means for shimming the face pieces to an aligned depth relationship with respect to other face pieces in a face piece arrangement.

32. The apparatus of claim 30 wherein the means for rotatably attaching separate, eccentric motion producing support sections is threaded cooperation between the support sections and the mounting bolts.

* * * * *